United States Patent [19]

Stanich

[11] Patent Number: 4,882,918

[45] **Date of Patent: * Nov. 28, 1989**

[54] PADLOCK COVER

[75] Inventor: Judith A. Stanich, Pompano Beach, Fla.

[73] Assignee: Hot Locks, Inc., Pompano Beach, Fla.

[ * ] Notice: The portion of the term of this patent subsequent to Dec. 3, 2002 has been disclaimed.

[21] Appl. No.: 133,553

[22] Filed: Dec. 16, 1987

Related U.S. Application Data

[63] Continuation-in-part of Ser. No. 803,084, Nov. 27, 1985, Pat. No. 4,819,465, and a continuation-in-part of Ser. No. 802,767, Nov. 27, 1985, Pat. No. 4,744,229, which is a continuation of Ser. No. 618,685, Jun. 8, 1984, Pat. No. 4,555,920, which is a continuation-in-part of Ser. No. 554,903, Nov. 25, 1983, Pat. No. 4,534,190.

[51] Int. Cl.[4] ..... E05B 67/38

[52] U.S. Cl. ..... 70/54; 70/56

[58] Field of Search ..... 70/14, 51, 54, 55, 56, 70/20, 417; 150/52

[56] References Cited

U.S. PATENT DOCUMENTS

| | | |
|---|---|---|
| 6,614 | 4/1873 | Bringman . |
| 18,436 | 9/1880 | Tower . |
| 205,904 | 10/1966 | Smith et al. . |
| 209,082 | 10/1867 | Williams . |
| 243,150 | 1/1877 | Dykes . |
| 483,345 | 9/1892 | Carvell . |
| 1,291,993 | 1/1919 | Matthews . |
| 1,346,414 | 7/1920 | Murphy . |
| 1,581,953 | 4/1926 | Jackson . |
| 2,541,638 | 2/1951 | Clevett . |
| 3,533,253 | 10/1970 | Miller et al. . |
| 3,858,419 | 1/1975 | Hampton . |
| 4,134,280 | 1/1979 | Pelavin et al. . |
| 4,286,445 | 9/1981 | Sills . |
| 4,297,861 | 11/1981 | Dykes . |
| 4,300,370 | 11/1981 | Kaiser et al. . |
| 4,506,528 | 3/1985 | Eberly . |
| 4,548,058 | 10/1985 | Bahry et al. . |
| 4,576,022 | 3/1986 | Gamble ..... 70/55 |
| 4,581,907 | 4/1986 | Eberly . |

FOREIGN PATENT DOCUMENTS

| | | |
|---|---|---|
| 154804 | 10/1938 | Austria . |
| 156072 | 5/1939 | Austria . |
| 400959 | 8/1924 | Netherlands . |
| 203530 | 9/1923 | United Kingdom . |
| 1365684 | 9/1974 | United Kingdom . |

*Primary Examiner*—Robert L. Wolfe

*Attorney, Agent, or Firm*—Grimes & Battersby

[57] ABSTRACT

A cover is provided for attachment to a padlock of the type having a body portion, an inverted, U-shaped shackle with a pair of opposed legs which extends from the body portion and locking mechanism for locking and unlocking the padlock.

The cover, includes front and rear portions, and retaining member adapted to prevent movement of the body portion of the padlock within the cover in a first plane defined by the shackle. The retaining member comprises an inner wall portion surrounding the body portion of the padlock and which is adapted to receive and capture the body portion of the padlock therein. Securing structure is further provided to prevent movement of the body portion of the padlock within the cover in a second plane perpendicular to the first plane.

20 Claims, 8 Drawing Sheets

FIG. 7
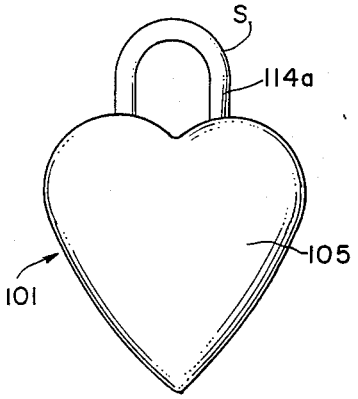
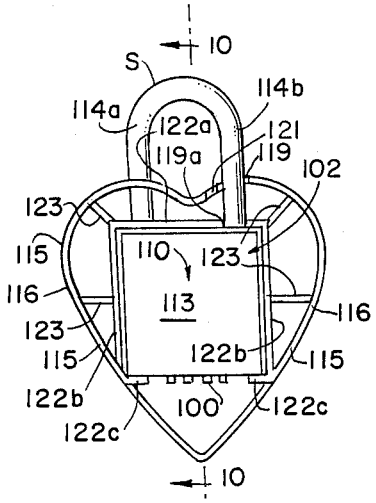
FIG. 8
FIG. 9
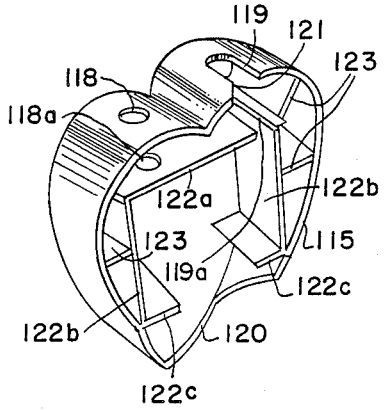
FIG. 10
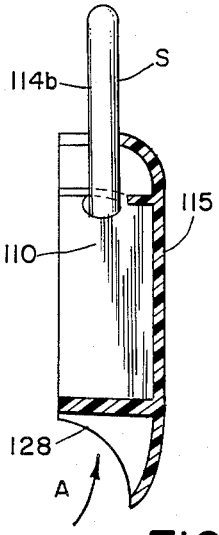
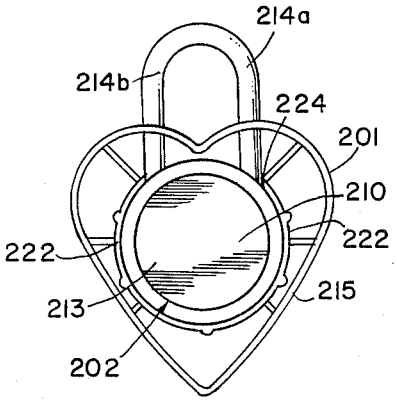
FIG. 11
FIG. 14
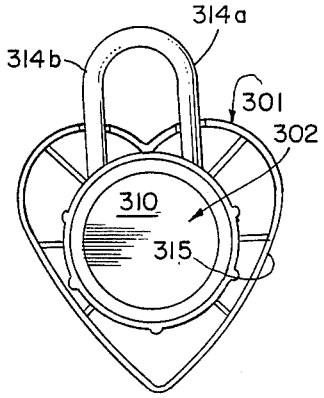
FIG. 12
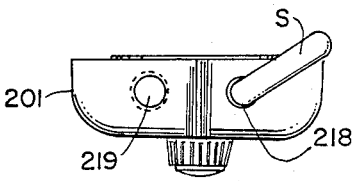
FIG. 15
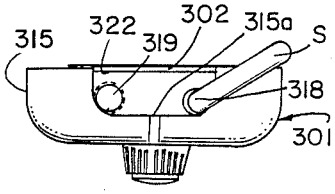
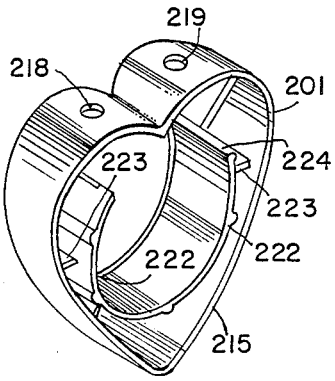
FIG. 13
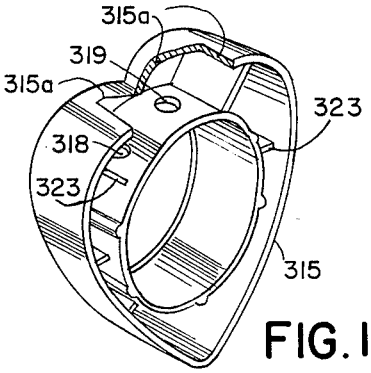
FIG. 16

PADLOCK COVER

CROSS-REFERENCE TO RELATED APPLICATIONS

This application is a continuation-in-part of application Ser. No. 06/802,767, filed on Nov. 27, 1985 which issued on May 17, 1988 into U.S. Pat. No. 4,744,229, and is a continuation-in-part of application Ser. No. 06/803,084, filed on Nov. 27, 1985, which issued on Apr. 11, 1989 into U.S. Pat. No. 4,819,465. Application Ser. No. 06/802,767 is a continuation and application Ser. No. 06/803,084 is a continuation-in-part of application Ser. No. 618,685, filed on June 8, 1984, which issued on Dec. 3, 1985 into U.S. Pat. No. 4,555,920, which is a continuation-in-part of application Ser. No. 554,903, filed on Nov. 25, 1983, which issued on Aug. 13, 1985 into U.S. Pat. No. 4,534,190.

BACKGROUND OF THE INVENTION

1. Field of the Invention

The present invention relates generally to a padlock cover and, more importantly, to such a cover which is not only aesthetically pleasing but which is tamper-proof and which assists in rendering the padlock tamper-proof and damage proof.

2. Description of the Prior Art

One widely used type of padlock has a cylindrical body containing a combination lock operated by a rotatable knob on the front, and an inverted, U-shaped shackle extending up from the body of the lock. Such locks are starkly utilitarian in appearance. Other types of locks are more U-shaped in appearance with means for opening the lock (i.e., keyhole or combination dials) provided at the bottom of the lock opposite the shackle. Such locks are also starkly utilitarian in appearance.

The present invention is directed to a novel cover for attachment to such a lock to improve and individualize its appearance, thereby making it readily identifiable from similar locks, such as in a row of lockers, and to protect the lock against damage from the outside by vandals as well as natures elements.

In one embodiment, the present cover is a one-piece, molded body, preferably formed from plastic, which can be assembled on or removed from a padlock relatively easily when the lock is open. However, the cover cannot be removed from the lock when the lock is closed except by damaging the cover itself, which features inhibits one from stealing the cover from the padlock.

In an alternative embodiment, the cover comprises the same one-piece body but also includes a hinged face plate to cover the dial or key portion of the padlock.

In another alternative embodiment, the cover comprises two components which can be lockingly engaged about the padlock cover in a sandwich or clam-shell fashion. The engagement can be such that, once the cover is secured to the padlock, it cannot be removed without destroying the cover engagement mechanism or other portions of the cover.

SUMMARY OF THE INVENTION

A principal object of the present invention is to provide a novel cover for attachment to a padlock to improve its appearance and make it more readily distinguishable from other padlocks which may be located nearby.

Another object of the present invention is to provide such a cover which is attachable to or removable from a padlock when it is open, but is not removable when the lock is closed except by damaging the cover.

A further object is to provide such a cover which includes a face plate to cover the dials or keyhole of the padlock when the dials or keyhole is not being used.

A yet another object of the present invention is to provide such a cover which does not interfere with the usual operation of the padlock when the cover is in place.

A still further object of the present invention is to provide such a cover which when the face plate covers the dial of the padlock, the dial is protected from damage.

A yet further object of the present invention is to provide such a cover which face plate can readily be moved from an open position to a closed position.

To accomplishment the foregoing objects and advantages, the present invention, in brief summary, comprises a cover for use in attachment to a padlock of the type having a body portion, an inverted, U-shaped shackle with a pair of opposed legs extending from said body portion and locking mechanism for locking and unlocking the padlock.

The cover, which includes front and rear portions, includes retaining means adapted to prevent movement of the body portion of the padlock within the cover in a first plane defined by the shackle, and securing means. The retaining means comprises an inner wall portion surrounding the body portion of the padlock and is adapted to receive and capture the body portion of the padlock therein. The securing means prevents movement of the body portion of the padlock within said cover in a second plane perpendicular to the first plane. In an alternative embodiment, the cover also includes a face plate which is movable back and forth from an open position in which one has access to the dial or keyhole of the padlock, to a closed position in which the dial or keyhole of the padlock is concealed by the face plate.

BRIEF DESCRIPTION OF THE DRAWINGS

The foregoing and still other objects and advantages of the present invention will be more apparent from the following detailed explanation of the preferred embodiments of the invention in connection with the accompanying drawings wherein:

FIG. 7 is a front elevational view of an alternative embodiment of the cover assembly of the present invention in place on a padlock of conventional design;

FIG. 8 is a rear elevation of the cover assembly and padlock shown in FIG. 7;

FIG. 9 is a rear perspective view of the cover assembly shown in FIGS. 7-8;

FIG. 10 is a vertical section taken along the line 10—10 of FIG. 8;

FIG. 11 is a rear elevational view of another embodiment of the cover assembly and padlock, which is similar to that shown in FIG. 2, but wherein the padlock cover has two holes in its outer side wall;

FIG. 12 is a top plan view of the cover assembly and padlock shown in FIG. 11;

FIG. 13 is a rear perspective view of the padlock cover assembly shown in FIG. 11;

FIG. 14 is a rear elevational view of still another embodiment of the cover assembly and padlock, which is similar to that shown in FIG. 2, but wherein the padlock cover assembly has an outer side wall with a hollowed out section;

FIG. 15 is a top plan view of the cover assembly and padlock shown in FIG. 14;

FIG. 16 is a rear perspective view of the padlock cover assembly shown in FIG. 14;

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DESCRIPTION OF THE PREFERRED EMBODIMENTS

Figure 1:
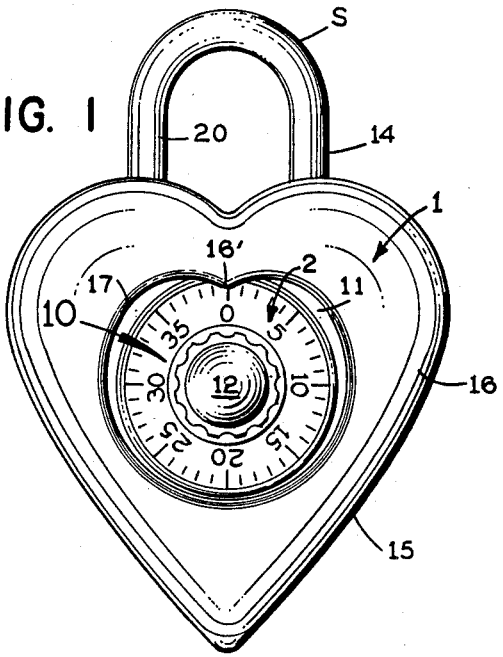
FIG. 1 is a front elevational view of the cover assembly of one embodiment of this invention in place on a padlock of conventional design.
Figure 2:
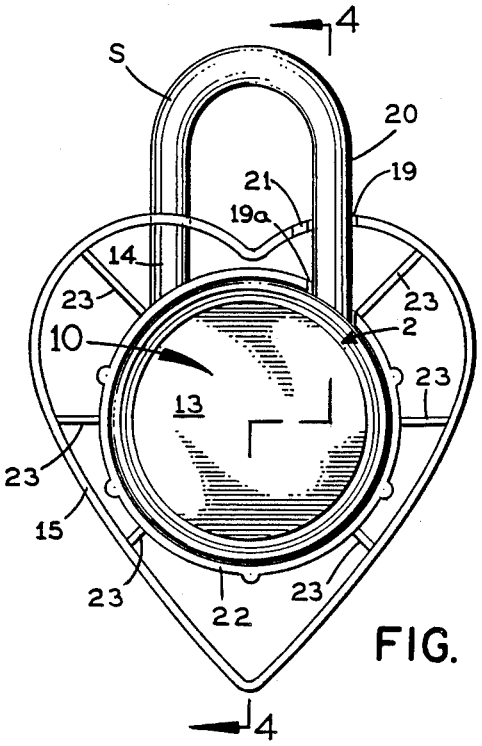
FIG. 2 is a rear elevational view of the cover assembly and padlock shown in FIG. 1.

Referring to the drawings and in particular FIG. 1, a padlock of known design generally represented by reference numeral 2 is shown as having a cylindrical body 10 with a front end face 11 where a spindle with rotatable knob or dial 12 is located and a back end face 13 (shown in FIG. 2). The knob or dial 12 operates a combination lock mechanism inside the body of the padlock in the usual manner. At the top, the padlock has the usual rigid reciprocable and rotatable shackle S of inverted U-shape which is down when the lock is closed in the locked position as shown in FIG. 1 and is displaceable upward with respect to the padlock body when the lock is open in the released position (not shown). When the lock is open, the padlock body may be rotated about one vertical leg 14 of the shackle, or vice-versa, from the locking position of FIG. 3 to the released position of FIG. 5.

As shown in the embodiment of FIGS. 1-6, the cover assembly or cover 1 is a substantially rigid, one-piece molded body of suitable plastic material having a heart-shaped outer side wall 15, and a slightly rounded/convex, front wall 16 extending laterally inward from the outer side wall 15 to a central opening 17. At the top of opening 17, the front wall 16 of the cover presents a downwardly projecting central lip 16′ which extends directly in front of the front end face 11 of the padlock body 10. Throughout its extent the edge of the opening 17 is a substantial distance radially outward from the knob 12 of the padlock so that it does not impede the user's fingers when he or she grasps the knob and turns it.

Figure 3:
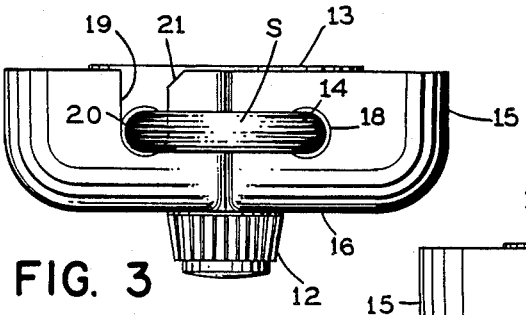
FIG. 3 is a top plan view of the cover assembly and padlock shown in FIG. 1 with the shackle of the padlock in its closed position.
Figure 5:
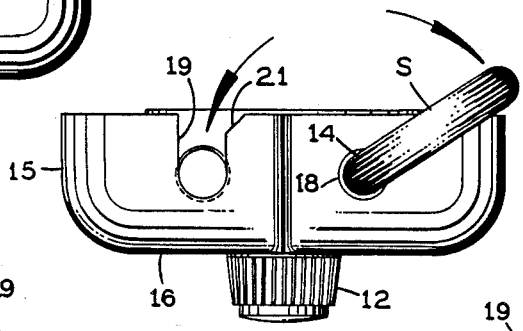
FIG. 5 is a top plan view of the cover assembly and padlock shown in FIG. 1 with the shackle of the padlock open and rotated from its closed position.

At the top on one side, the outer side wall 15 of the cover presents a circular opening 18 (FIG. 6) which rotatably and slidable receives the leg 14 of the padlock shackle S, as shown in FIGS. 3 and 5. At the top on the opposite side, the outer side wall 15 of the cover presents a slot 19 which is open at the back of the cover and has a rounded, closed front end. This slot slidably receives the opposite vertical leg 20 of the padlock shackle S. Slot 19 has a chamfered edge 21 on its inner side at the back of the cover to facilitate the movement of shackle leg 20 into or out of this slot when the shackle is rotated on its opposite leg 14.

Figure 6:
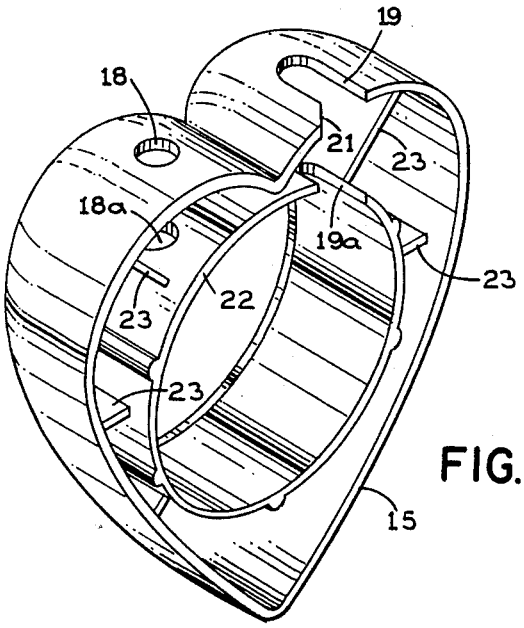
FIG. 6 is a rear perspective view of the cover assembly shown in FIG. 1.

In this embodiment, the present cover has a cylindrical inner wall 22 spaced laterally inward from its outer wall 15 and joined to the outer wall by lateral ribs 23 extending between them, as shown in FIGS. 2 and 6. The cylindrical inside surface of inner wall 22 is substantially complementary to the cylindrical side wall of the padlock body 10, so that the padlock body is slidably but snugly received inside the inner side wall 22 of the cover, as shown in FIG. 2. At the lip 16′ (FIG. 1) and on opposite sides of it along the top of the front opening 17, the front wall 16 of the cover extends laterally inward past the inner wall 22 to engage the front of the padlock body 10.

The inner side wall 22 on one side of its top has an opening 18*a* (FIG. 6) which is spaced below, and vertically aligned with, the opening 18 in the outer side wall 15. The inner side wall 22 on the opposite side at its top has a slot 19*a* (FIGS. 4 and 6) which is spaced below, and vertically aligned with, the slot 19 in the outer side wall 15 and is the same size and shape as the latter, when looking down on the cover from above. The inner side wall opening 18*a* slidably and rotatably receives the padlock shackle leg 14, and the slot 19*a* slidably passes the opposite leg 20 of the shackle.

Figure 4:
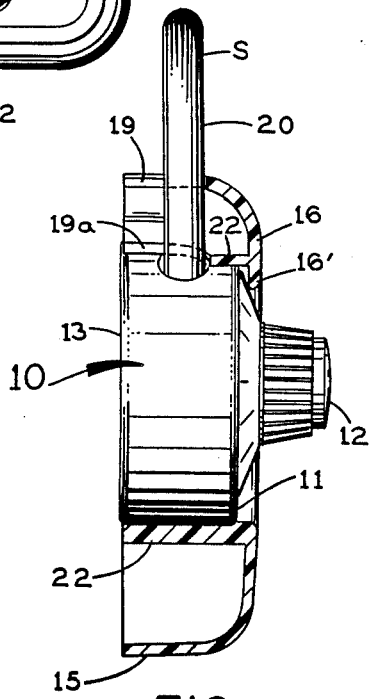
FIG. 4 is a vertical section taken along line 4—4 in FIG. 2.

With the shackle S in an open or released position, the padlock 10 may be placed inside the present cover by positioning the padlock body behind the cover and sliding the free end of shackle leg 20 through opening 18*a* in the inner side wall 22 of the cover and then out through the aligned opening 18 in the outer side wall 15 of the cover, and then pushing the rest of the shackle S through these openings until the opposite shackle leg 14 is in these openings and then padlock body is seated inside the inner side wall 22 of the cover, with the rotatable knob 12 of the padlock in front of the cover, as shown in FIG. 4. The shackle may be rotated from its open or released or unlocked position (FIG. 5) to the closed or locked position (FIG. 3) in which its leg 20 may be pushed into the padlock body 10 for locking engagement with the locking mechanism therein.

When the padlock is closed, the present cover cannot be removed from it because of the engagement of the shackle leg 14 in the openings 18 and 18*a* in the cover. This effectively prevents any removal of the cover by a person who does not know the combination to open the lock. When the lock is open, the present cover may be mounted on it or removed from it without great difficulty. Ordinarily, however, the owner will keep the cover on as long as the lock is in use since it provides physical protection for the lock, as well as identifying it to the owner and improving its appearance.

An alternative embodiment of the cover of the present invention is illustrated in FIGS. 7–10, where the cover 101 is adapted to be used in association with a padlock 102 adapted to be accessed from the underside 111 of the body 110 of the padlock 102. Since there is no need to access any combination knob on the face of the padlock 102 in the embodiment of FIGS. 7–10, the face 105 of the cover 101 may be closed.

The body 110 of the padlock 102 which can be used in conjunction with the alternative cover 101 of FIG. 7 can be cylindrical, square or rectangular with a back end face 113. The padlock 102 illustrated in FIG. 8 is of the type having a locking mechanism 100, preferably a digital dial mechanism, for opening the padlock upon dialing the appropriate combination. Examples of such types of locks are the Sesamee padlocks. Alternatively, the locking mechanism 100 may be a keyhole lock mechanism (not shown) rather than the digital lock mechanism 100 shown in FIG. 8, for use with locks that are opened with keys.

Such padlocks have, at their tops, a typical inverted, U-shaped, rigid reciprocable and rotatable shackle S having a fixed, rotatable vertical leg 114*a* and a free, locking vertical leg 114*b* which are downwardly positioned when the lock is closed. The legs 114*a* and 114*b* of the shackle S are upwardly displaceable relative to the padlock body 110 when the lock is opened. When the lock is opened, the fixed vertical leg 114*a* of the shackle S may be rotated about the padlock body 110 and the free leg 114*b* swung out to engage or disengage the article to be locked. It will be appreciated, however, that shackle S need not be rotatable but, instead, in a further alternative embodiment (not shown), both legs 114 of the shackle S′ may be entirely removable from the body 110 of the padlock in an unlocked position.

The padlock cover 101 is substantially rigid and may be one-piece, or may be comprised of several individual pieces which, when combined, form a cover suitable to envelope a padlock of the type discussed. The cover 101 can be formed by using any material which will render it substantially rigid and hard. Preferably, the cover is made of a thermoplastic material such as, for example, polyethylene, polypropylene or the like.

Access to the locking mechanism 100 of the padlock 102 is effected through a cutout 128 at the bottom of the cover 101, shown best in FIGS. 8–10.

The padlock cover 101 of the embodiment of FIGS. 7–10 has an outer side wall 115 and a front wall 116 which, in a preferred embodiment, is slightly rounded or convex and which extends inwardly from the outer side wall 115. The outer side wall 115 and, thus, the resultant cover 101, can assume virtually any shape. The cover 101 illustrated in FIGS. 7–10 is heart-shaped. Alternative designs for the cover 101 include, for example, "lips," "footballs," "helmets," "stars," "tires," "unicorns," and the like.

The manner in which the padlock 102 is mounted to the cover 101 is shown in greater detail in FIGS. 8–10. As shown therein, the padlock 102 is adapted to be tightly received within the cover 101 between a series of internal walls 122*a–c* which serve to envelope the padlock 102 and to prevent movement of the padlock 102 within the cover 101. Internal walls 122*a–c* include an internal upper wall 122*a*, a pair of opposed internal side walls 122*b* and a pair of internal lower half walls 122*c*. Internal side walls 122*b* are inwardly spaced from the outer side wall 115 of the cover 102 by lateral ribs 123 which extend between the outer side wall 115 and the internal side walls 122*b*.

The internal walls 122*a–c* of the cover 101 define a preferably square or rectangular opening adapted to tightly receive and retain the body 110 of the padlock 102. Internal upper wall 122*a* has an enclosed aperture 118*a* which is spaced below, and vertically aligned with, a complimentary enclosed aperture 118 in the outer side wall 115 of the cover 101. The internal upper wall 122*a* also has a second slot 119*a* which is spaced below, and vertically aligned with, a complimentary slot 119 in the outer side wall 115 of the cover 101. The enclosed apertures 118 and 118*a* on the one hand and the slots 119 and 119*a* on the other hand are substantially the same size and shape.

Slot 119 has a chamfered edge 121 on its inner side at the rear of the cover 101 to facilitate the movement of the free shackle leg 114*b* into or out of the slot when the fixed shackle leg 114*a* is rotated about the body 110 of the padlock 102.

The fixed shackle leg 114*a*, which is fixed to the body 110 of the padlock 102, is adapted to pass through the enclosed aperture 118*a* in the internal upper wall 122*a* and the enclosed aperture 118 in the outer side wall 115 of the cover 101 upon mounting of the cover on the padlock. The free shackle leg 114*b*, which is releasable relative to the body 110 of the padlock 102, can pass through the slot 119*a* in the internal upper wall 122*a* and the complimentary slot 119 in the outer side wall 115. In this manner, the fixed shackle leg 114*a* is captured within the enclosed aperture 118*a* while the free leg 114*b*, upon disengagement from the body 110 of the padlock 102, is free to swing out from the slots 119 and 119*a*.

It will be appreciated, however, that when the padlock 102 is in a closed position as shown, for example, in FIG. 8, the padlock 102 is tightly captured or retained within the cover 101. Lateral movement of the padlock 102 is prevented by internal walls 122 which tightly capture the body 110 of the padlock 102. Lateral movement of the padlock 102, as well as forward, backward, angular and rotational movement, is also prevented by the capture of the shackle leg 114*a* within the enclosed apertures 118 and 118*a*. The utilization of slots 119 and 119*a* permit the shackle S to be opened for engagement and disengagement with an article to be locked (not shown).

Thus, when the padlock 102 is closed, the cover 101 cannot be removed from the padlock 102 because of the engagement of the shackle leg 114*a* within the enclosed apertures 118 and 118*a*. This effectively prevents unauthorized removal of the cover 101 by any person who cannot also unlock the padlock 102. When the padlock 102 is unlocked and the shackle leg 114*b* is swung out, the cover 101 may be removed without great difficulty. Ordinarily, however, the owner will keep the cover on so long as the padlock 102 is in use since it provides physical protection for the padlock 102, as well as identifying it to the owner and improving its appearance.

A further embodiment of the cover 201 of the present invention is shown in FIGS. 11–13. It will be appreciated that the cover 201, which has an outer side wall 215, is similar in appearance and structure to the cover illustrated in FIGS. 1–6. In the embodiment of FIGS. 11–13, however, two enclosed apertures 218 and 219 are provided in the outer side wall 215 of the cover 201 through which the legs 214*a* and 214*b* of the shackle S of the padlock 202 are adapted to pass. When the padlock 202 is in a closed or locked position with the cover 201 in place as shown in FIG. 11, the legs 214*a* and 214*b* of the shackle S pass through and are captured within the enclosed apertures 218 and 219 in the outer side wall 215.

An internal side wall 222, supported by a plurality of lateral ribs 223 connecting the internal side wall 222 to the outer side wall 215 at a number of places about the internal side wall 222, is further provided for receiving and capturing the body 210 of the padlock 202 within the cover 201. The shape of the internal side wall 222 is generally complimentary to the body 210 of the padlock 202 which it is adapted to receive. Thus, if the body 210 of the padlock 202 is round, the internal side wall would likewise be round. If the body 210 of the padlock 202 is rectangular or square, the internal side wall 222 would likewise be rectangular or square in shape.

The internal side wall 222 of the cover 201 is adapted to receive and tightly capture the body portion 210 of the padlock 202. Lateral movement of the padlock 202 is prevented by internal side wall 222. Lateral movement, as well as forward, backward, angular and rotational movement, of the padlock 202, is also prevented by the capture of the shackle legs 214*a* and 214*b* within the enclosed apertures 218 and 219.

The upper portion 224 of the internal side wall 222 is open to permit vertical movement of the body 210 of padlock 202 in the direction of the top portion of the outer side wall 215 of the cover 201.

It will be appreciated that, operationally, the body 210 of the padlock 202 is inserted into the cavity defined by the internal side wall 222 and the legs of the shackle S are passed through the enclosed apertures 218 and 219. When the padlock 202 is in a closed or locked position as shown in FIG. 11, the body 210 of the padlock 202 is captured within the cover by the internal wall 222 and shackle S is captured at both legs 214*a* and 214*b* by the enclosed apertures 218 and 219 in the outer side wall 215.

When the padlock 202 is unlocked, the body 210 of the padlock is moved upwardly toward the top of the outer side wall 215, the shackle S is drawn upwardly freeing the free leg 214*b* of the shackle S and the shackle S is rotated about its fixed leg 214*a* to permit removal of the padlock 202 from the article to which it had been attached.

A still-further embodiment of the present invention is illustrated in FIGS. 14–16. The cover 301 of this embodiment is similar in design and shape to the cover in the embodiment of FIGS. 11–13 except that top portion of the outer side wall 315 is open at 315*a* to accommodate free movement of both legs 314*a* and 314*b* of the shackle S. In this embodiment, the internal side wall 322, which is supported by lateral ribs 323, surrounds and captures the body 310 of the padlock 302. Two enclosed apertures 318 and 319 are provided in the top portion of the internal wall to permit the legs 314*a* and 314*b* of the shackle S to pass therethrough.

The cover 301 of the embodiment of FIGS. 14–16 functions in the following manner. With its shackle S in an open or unlocked position, the free leg 314*a* of the shackle S is inserted through the underside of the enclosed aperture 318 in the internal wall and the body 310 of the padlock 302 is then inserted into the cavity defined by the internal wall 322. To lock the padlock, the free leg 314*a* of the shackle is then inserted through the second enclosed aperture 319 and locking is effected.

It will be appreciated that the cover 301 is retained about the padlock 302 since the padlock 302 is tightly captured within the internal wall 322 which thereby prevents lateral movement of the padlock 302. Lateral movement, as well as forward, backward, angular and rotational movement, of the padlock 302, is also prevented by the capture of the shackle legs 314*a* and 314*b* within the enclosed apertures 318 and 319. For removal, the free leg 314*a* is released, the shackle S is raised upwardly and the shackle is pivoted about the fixed leg 314*b* to release the padlock 302 from the article to which it had been locked.

Figure 17:
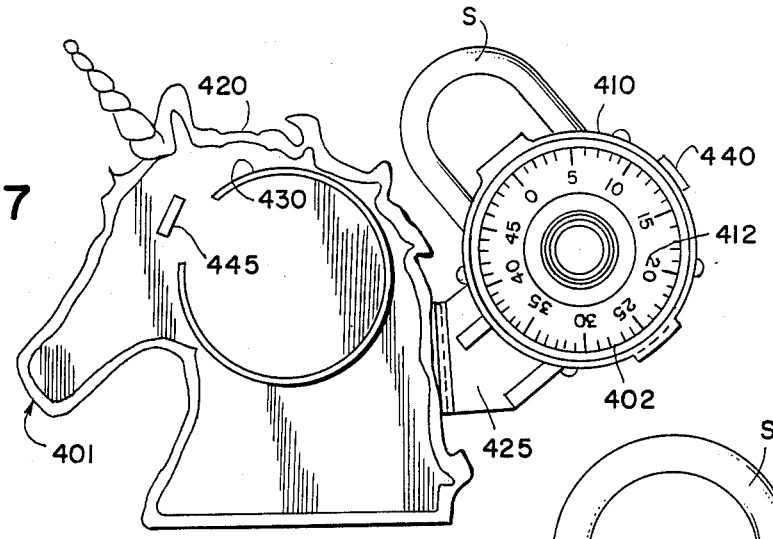
FIG. 17 a front elevational view of yet another embodiment of the cover assembly and padlock of conventional design, in which the cover is comprised of two components which can be moved from an open configuration, as shown, where the unicorn head mounted on one portion is in a swung out position, to a closed position (not shown) sandwiching or enveloping the padlock.
Figure 18:
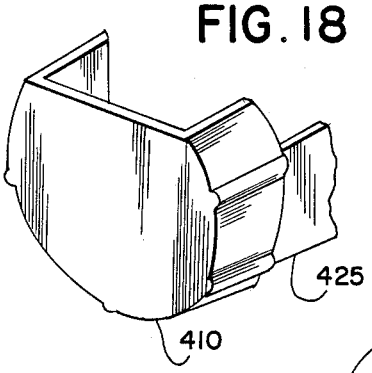
FIG. 18 is a rear perspective view of one component of the cover assembly shown in FIG. 17, specifically, the sleeve used to accommodate the padlock.

A further embodiment of the cover 401 of the present invention is illustrated generally in FIGS. 17–18. The cover 401 of this embodiment includes a padlock holder 410 adapted to capture and retain the padlock 402 and a cover 420 adapted to engage said padlock holder 410 and cover said padlock 402. The cover 420 can take virtually any shape or configuration. For example, as shown in FIG. 17, it may take the shape of a unicorn. Other possible shapes include, for example, teddy bears, hearts, tires, stars or the like.

As shown in greater detail in FIG. 18, the padlock holder 410 is adapted to engage and secure the padlock 402. The holder 410 may take the form, as shown in FIG. 18, of a cup like structure which encircles or surrounds the padlock 402 in order to capture the padlock therein. The padlock 402 may be retained within the holder 410 by any suitable means including, for example, gluing or adhesively bonding the padlock 402 therein. Alternatively, the top portion of the holder 410 may be structured in a similar manner (not shown) to the internal walls of the earlier embodiments where enclosed apertures are provided through which the legs of the shackle S of the padlock 402 pass and are captured therein.

The holder 410 is secured to the cover 420 by hinge 425. The hinge 425 permits the cover 420 to be opened and closed to alternately expose and cover the padlock 402. An internal seat 430 is provided within the cover 410 which is complimentary in shape to the padlock 402 which is contained within the holder 410. In this manner, when the cover 420 is closed over the padlock 402, the padlock 402 is properly seated within both the cover and retaining portions.

Complimentary engaging devices are provided in both the cover 420 and the holder 410 to secure the cover 420 to the holder 410 and the padlock 402. To this effect, at least one deformable latch 440 is provided in the holder adjacent to the padlock 402 which is adapted to engage a complimentary detent 445 on the inner surface of the cover 402.

An opening may be provided in the cover 420 (not shown) through which the face of the padlock 402 is visible and accessible.

In such event it may be desirable to semi-permanently or permanently secure the cover 420 to the holder 410 thereby securing the padlock 402 contained therein. Such semi-permanent or permanent securing may be accomplished by the use of a plurality of non-deformable detents which, once engaged, cannot be readily disengaged. Similarly, the cover 420 and the holder 410 may be secured by screws, adhesives or the like.

A still further embodiment of the cover of the present invention is illustrated generally in FIGS. 19–23, where the cover assembly 501 is in the shape of a ball, such as a soccer ball. It will be appreciated that cover or cover assembly, which 501 has an outer wall or outer side wall 515 with aperture 518 and slot 519 and an internal wall 522 with apertures 518*a* corresponding to aperture 518 and slot 519*a* corresponding to slot 519 is similar in structure to the embodiment of FIGS. 1–6. However, as shown in FIGS. 19–23, cover or cover assembly 501′ also includes a face plate 503 which is hinged to the body 501 of the cover assembly 501.

Figure 23:
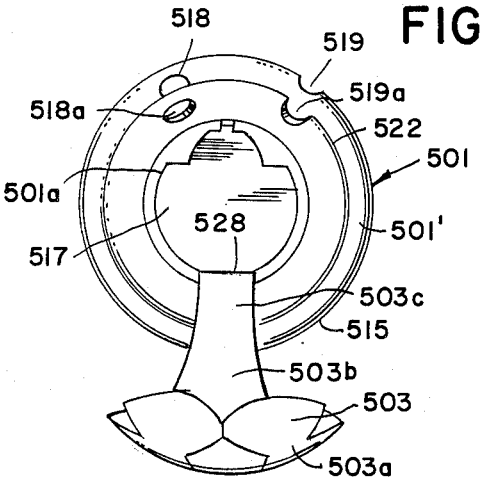
FIG. 23 is a rear perspective view of the cover assembly shown in FIG. 19, without the padlock, and with the face plate in its open position.

As best shown in FIG. 23, face plate 503 includes a body portion 503*a* complimentary to the shape or configuration of the body 501′ of the cover assembly 501, a shank 503*b* and a counterbalance 503*c*. A hinge is placed through the plane connecting the shank 503*b* to the counterbalance 503*c* and into the edge of outer wall 515 to connect the face plate 503 to the body 501′ of the cover assembly 501. Internal wall 522 may have an opening in the wall or a flat spot on the wall 528 to permit counterbalance 503*c* to move into the cover assembly 501 as the face plate 503 is opened.

Figure 19:
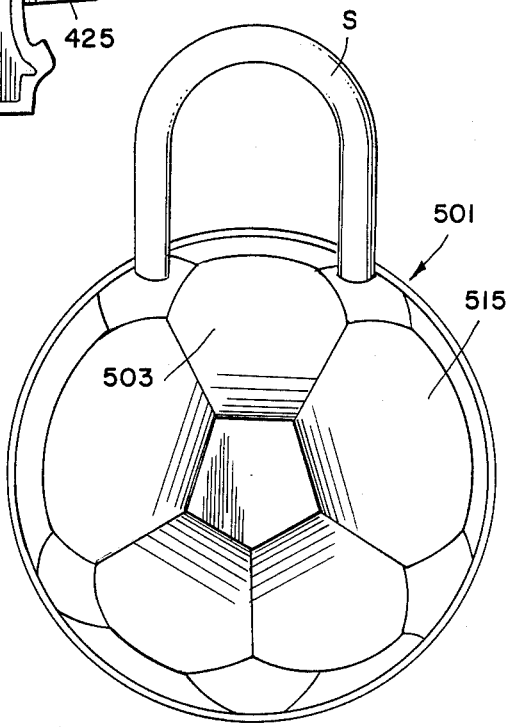
FIG. 19 is a front elevational view of still yet another embodiment of the cover assembly of the present invention in place on a padlock of conventional design in which the cover assembly includes a face plate which is in its closed position.

In this embodiment when the face plate 503 is in its closed position as shown in FIG. 19, the face plate mates with the outer wall 515 of the cover 501 to completely envelope the knob 512 as well as spindle 512*a* of padlock 502 so that from a front view only the shank S of the padlock is visible. Specifically, the cover plate 503 mates with edge 501*a* formed about central opening 517 of the body 501′ of cover 501 so that the padlock 502 cannot, as illustrated in FIG. 19, be seen along edge 501*a* when cover plate 503 is closed.

Figure 20:
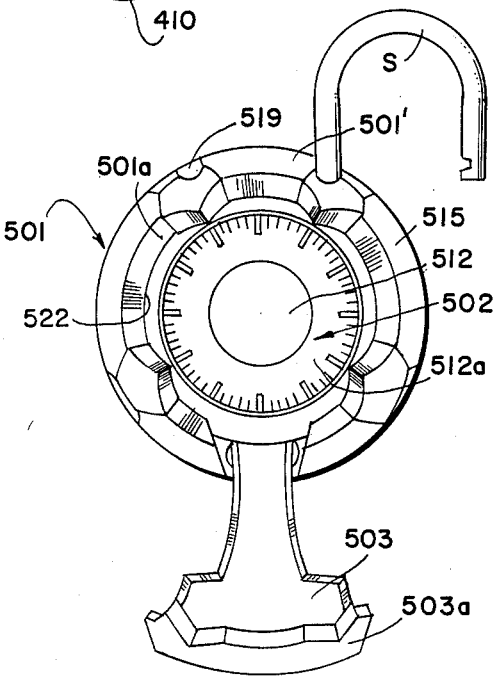
FIG. 20 is a front elevational view of the cover assembly shown in FIG. 19 in which the face plate of the cover assembly and the shackle of the padlock are in their open positions.

As shown in FIG. 20, edge 501*a* extends from internal wall 522 outward in an arcuate manner to outer wall 515. Analogously, cover plate 503 has an arcuate edge 503*a* which is complimentary to edge 501*a* so that the edges mate when the cover plate is in its closed position as shown in FIG. 19. In its closed position, the face plate 503 as well as the walls of cover 501 act to protect the knob 51 2 of the padlock 502 from damage which may be caused by striking the front of the cover 501 and padlock 502, as well as by natures elements.

To maintain face place 503 in its closed position, the counterbalance 503*c* can act so as bias to face plate 503 into mating engagement with the body 501′ of the cover assembly 501. However, complimentary engaging devices (not shown) can also be provided in the face plate 503 and body 501′ to secure in its closed position the face plate 503 to the body 501. To effect this, a deformable latch can be provided in the face plate 503 which is adapted to engage a complimentary detent on the edge 501*a* of the body 501′.

Figure 21:
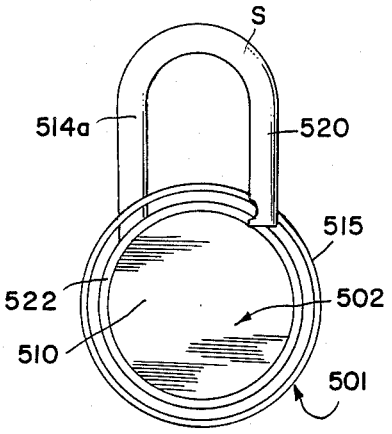
FIG. 21 is a rear elevational view of the cover assembly and the padlock shown in FIG. 19.
Figure 22:
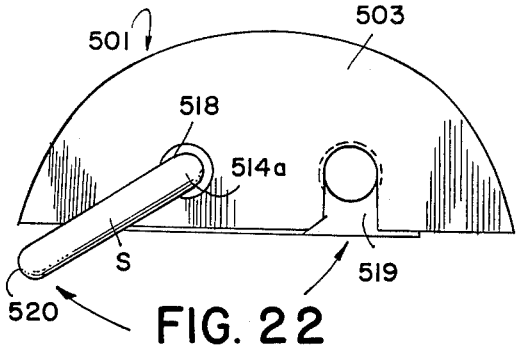
FIG. 22 is a top plan view of the cover assembly shown in FIG. 19 with the shackle of the padlock in its open position.

Referring to FIGS. 21 and 23, internal wall 522 is basically cylindrical and is spaced laterally inward from outer wall 515. In this embodiment, internal wall 522 is connected to outer wall 515, preferably, only by the mating of both walls adjacent edge 501*a*. Accordingly, the cover 501 with internal wall 522 and outer wall 515 is a one molded piece. While the cover 501 can be formed by using any material which will render it substantially rigid and hard, preferably, the material is a thermoplastic material such as, for example, polyethylene, polypropylene or the like. It has been found that the one piece molded cover 501 has enough strength so that the internal wall 522 can rigidly retain the padlock 502 and remain spaced from outer wall 515 without either wall collapsing. However, should additional strength be desired to support internal wall 522 and outer wall 515, the walls can be connected by lateral ribs such as those shown, for example, in the embodiments of FIGS. 1–6, 11–13, and 14–16.

Referring to FIG. 23, the internal wall 522 on one side of its top has an opening 518*a* and on the other side of its top has a slot 519*a*. Likewise, outer wall 515 has on one side of its top an opening 518 and has on the other side of its top a slot 519. The opening 518*a* of internal wall 522 vertically aligns with opening 518 of outer wall 515, and likewise slot 519 vertically aligns with slot 519*a*. The internal wall opening 518*a* slidably and rotatably receives the fixed rotatable leg 514*a* of the padlock shackle S, and slot 519*a* slidably passes the other or movable leg 520 of the shackle.

In this embodiment, the fixed shackle leg 514*a*, which is fixed to the body 510 of the padlock 502, is adapted to pass through the enclosed aperture 518*a* in internal wall 522 and the enclosed aperture 118 in the outer wall 515 of the cover 501 upon mounting of the cover on the padlock. The free shackle leg 520, which is releasable relative to the body 510 of the padlock 502, can pass through the slot 519*a* in the internal wall 522 and the complimentary slot 519 in the outer wall 515. In this manner, the fixed shackle leg 514*a* is captured within the enclosed aperture 518*a* while the free shackle leg 520, upon disengagement from the body 510 of the padlock 502, is free to swing out from the slots 519 and 519*a*.

The cylindrical inside surface of internal wall 522 is substantially complimentary to the cylindrical side wall of the body 510 of the padlock 502. Accordingly, the padlock body 510 is slidably but snugly received inside the internal wall 522 of the cover 501 as shown in FIG. 21, so that the internal wall serves to envelope and tightly capture the padlock 502 and thereby prevent lateral movement of the padlock. Lateral movement of the padlock 502, as well as forward, backward, angular and rotational movement, is also prevented by the capture of shackle leg 514*a* within enclosed apertures 518 and 518*a*.

It is understood that the outer wall 515 of the cover 502 can take any configuration and is preferable that it has the shape of some known object, such as a soccer ball, baseball, basketball, football or the like.

Figure 24:
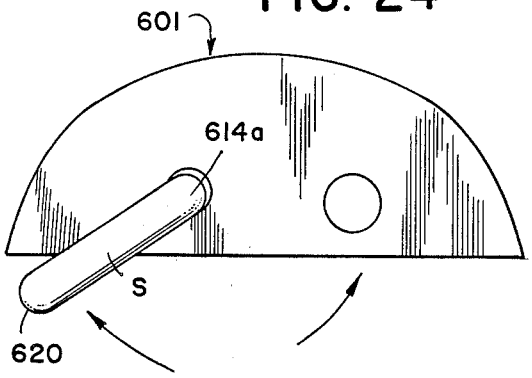
FIG. 24 is a top plan view of still yet another embodiment of the cover assembly of the present invention in place on a padlock of conventional design with the shackle of the padlock in its open position.
Figure 25:
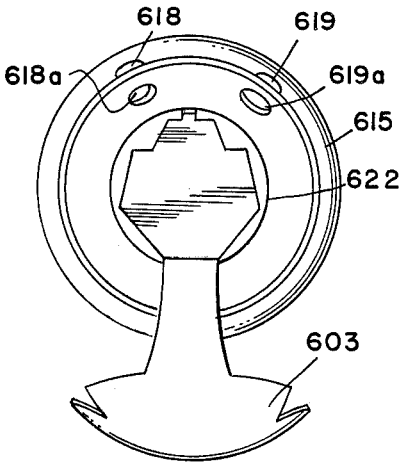
FIG. 25 is a rear perspective view of the cover assembly shown in FIG. 24, without the padlock, and with the face plate of the cover assembly in its opened position.

FIGS. 24 and 25 illustrate a still further embodiment of the cover of the present invention. The cover 601 is analogous to the cover 501 of FIGS. 19–23, except that both the outer wall 615 and the internal wall 622 have, on their top, a pair of enclosed apertures, or openings 618, 619 and 618*a*, 619*a*, respectively, analogous to the aperture structure of the embodiment of FIGS. 17–18 Aperture 618 in outer wall 615 aligns with aperture 618*a* in internal wall 622, likewise aperture 619 in outer wall 615 aligns with aperture 619*a* in internal wall 622. The internal wall aperture 618*a* and outer wall aperture 618 slidably and rotatably receive fixed, rotatable leg 614*a* of the padlock shackle S, while outer wall aperture 619 and internal wall aperture 619*a* receive the other or free leg 620 of the shackle when the shackle is in the locked position. To employ this embodiment, the shackle S of the padlock must have legs 614*a*, 620 of a height or vertical extent, such that once one leg of the shackle S has been slidable and rotatable receive in either set of aligned apertures 618, 618*a* or 619, 619*a* and the padlock 602 is in place in the cover 601, the shackle S can rotate without the other leg striking the body of the cover, i.e., the leg of the shackle swings or rotates above the top of the cover.

In this embodiment, with shackle S in an open or unlocked position, the free leg of the shackle S is inserted through the underside of enclosed aperture 618*a* in internal wall 622 and then through aperture 618 of outer wall 615. Then the free leg of the shackle S passes through aperture 619 of outer wall 615 and then through aperture 619*a* of internal wall 622. The internal wall 622 is complimentary to the shape of the padlock and the body of the padlock is snugly received inside the internal wall 622. The internal wall 622 serves to tightly capture and envelope the padlock so as to prevent lateral movement of the padlock. Lateral movement of the padlock, as well as forward, backward, angular and rotational movement is also prevented by the capture of the free leg of the shackle by enclosed apertures 618 and 618*a*.

Having thus described the invention with particular reference to the preferred forms thereof, it will be obvious that various changes and modifications may be made therein without departing from the spirit and scope of the invention as defined by the appended claims.

I claim:

1. A cover for attachment to a padlock of the type having a body portion and an inverted, U-shaped shackle extending from the body portion, said cover having front and rear portions and including:

retaining means comprising an inner wall portion which is generally complementary to the shape of the body portion of the padlock and is adapted to prevent of the body portion of the padlock within said cover in a first plane defined by the shackle, wherein said inner wall portion includes at least one aperture adapted to permit the shackle to pass therethrough and which captures the shackle therein;

securing means adapted to prevent movement of the body portion of the padlock within said cover in a second plane perpendicular to the first plane, wherein said securing means includes at least one aperture adapted to permit the shackle to pass therethrough; and a face plate adapted to enclose the face of the padlock.

2. A cover for attachment to a padlock of the type having a body portion, an inverted, U-shaped shackle having a pair of opposed legs which extends from the top of the body portion and a locking mechanism at the bottom of the body portion, said cover having a substantially enclosed front portion and a rear portion and including:

retaining means adapted to prevent movement of the body portion of the padlock within said cover in a first plane defined by the shackle, said retaining means comprising an inner wall portion adapted to receive and capture the body portion of the padlock; and means for providing access from the bottom of said cover to the locking mechanism at the bottom of the padlock; and securing means adapted to prevent movement of the body portion of the padlock within said cover in a second plane perpendicular to said first plane.

3. The cover according to claim 2, wherein said inner wall portion includes a pair of opposed internal side walls, an internal upper wall and a pair of partial internal bottom walls, and said access means comprises an opening defined by said pair of partial internal bottom walls, adapted to permit requisite access to the locking mechanism on the padlock.

4. The cover according to claim 3, wherein said cover includes an outer side wall which extends around a substantial portion of said cover.

5. The cover according to claim 4, wherein at least one enclosed aperture is provided in said internal upper wall through which at least one leg of the shackle of the padlock is adapted to pass and be captured therein when the padlock is in a locked condition.

6. The cover according to claim 4, wherein at least one enclosed aperture is provided in said outer side wall through which at least one leg of the shackle of the padlock is adapted to pass and be captured therein when the padlock is in a locked condition.

7. The cover according to claim 5, wherein at least one enclosed aperture is provided in said outer wall through which at least one leg of the shackle of the padlock is adapted to pass and be captured therein when the padlock is in a locked condition.

8. The cover according to claim 7, wherein said enclosed apertures in said outer side wall and said internal upper wall are complimentary in size, shape and location and wherein said at least one leg of the shackle of the padlock is adapted to pass through both such apertures and be captured therein when the padlock is in a locked condition.

9. The cover according to claim 7, wherein at least one slot is provided in the internal upper wall and adapted to receive the opposite leg of the shackle.

10. The cover according to claim 6, wherein at least one slot is provided in the outer side wall and is adapted to receive the opposite leg of the shackle.

11. The cover according to claim 7, wherein at least one slot is provided in each of the internal upper wall and the outer side wall and wherein said slots are adapted to receive the opposite leg of the shackle.

12. The cover according to claim 11, wherein said slots are complimentary in size, shape and location.

13. A cover for attachment to a padlock of the type having a body portion, an inverted, U-shaped shackle having a pair of opposed legs which extend from the top of the body portion, and a locking mechanism on the face of the body portion, said cover including an opening to permit access to the locking mechanism and further including:

an outer wall portion;

retaining means adapted to prevent movement of the body portion of the padlock within said cover in a first plane defined by the shackle, said retaining means comprising an inner wall portion adapted to receive and capture the body portion of the padlock; and securing means adapted to prevent movement of the body portion of the padlock within said cover in a second plane perpendicular to said first plane, said securing means comprising at least one enclosed aperture provided in said outer wall portion through which at least one leg of the shackle of the padlock is adapted to pass and be captured therein; and a face plate adapted to enclose the opening of said cover.

14. The cover according to claim 13, wherein said securing means comprises at least two enclosed apertures provided in said outer wall portion through which the legs of the shackle of the padlock are adapted to pass and be captured therein when the padlock is in a locked condition.

15. The cover according to claim 13, wherein said inner wall portion is open at the top portion thereof to permit free movement of the shackle of the padlock toward and away from said aperture.

16. A cover for attachment to a padlock of the type having a body portion, an inverted, U-shaped shackle having a pair of opposed legs which extends from the top of the body portion, and a locking mechanism on the body portion, said cover including:

retaining means adapted to prevent movement of the body portion of the padlock in a first plane defined by the shackle, said retaining means comprising a holder adapted to receive and capture the body portion of the padlock;

cover means; and means for engaging said cover means and said retaining means to thereby envelope the padlock.

17. The cover according to claim 16, wherein the padlock is adhesively bonded within said holder.

18. The cover according to claim 16, wherein said holder includes at least one enclosed aperture through which at least one of the legs of the shackle is adapted to pass and be captured therein when the padlock is in a locked condition.

19. The cover according to claim 16, wherein said cover includes an opening to permit access to the locking mechanism on the padlock.

20. The cover according to claim 16, wherein said means for engaging comprises a deformable locking tab on said holder and a detent on the inner surface of said cover.

* * * * *